United States Patent [19]

Maruhashi et al.

[11] Patent Number: 4,473,412

[45] Date of Patent: Sep. 25, 1984

[54] ANNEALING STEEL STRIP USING MOLTEN $B_2O_3$, $SIO_2$ $NA_2O$, NAF GLASS BATH

[75] Inventors: Shigeaki Maruhashi; Takayoshi Kanamaru; Hiroto Matsumoto, all of Tokuyama; Kousuke Sawashige, Houfu, all of Japan

[73] Assignee: Nisshin Steel Co., Ltd., Tokyo, Japan

[21] Appl. No.: 463,737

[22] Filed: Feb. 4, 1983

[30] Foreign Application Priority Data

Mar. 24, 1982 [JP] Japan ..... 57-46704

[51] Int. Cl.[3] ..... C21D 1/56

[52] U.S. Cl. ..... 148/15; 148/20.6; 148/27

[58] Field of Search ..... 148/15, 27, 20.6

[56] References Cited

U.S. PATENT DOCUMENTS

| | | | |
|---|---|---|---|
| 1,919,136 | 7/1933 | Smith | 148/15 |
| 2,328,932 | 9/1943 | Streicher | 148/15 |
| 2,328,933 | 9/1943 | Streicher | 148/15 |
| 2,337,186 | 12/1943 | Caugherty | 148/15 |
| 3,158,515 | 11/1964 | Michael | 148/20.6 |
| 4,358,544 | 11/1982 | Skedgell | 148/27 |

*Primary Examiner*—Veronica O'Keefe

*Attorney, Agent, or Firm*—Kane, Dalsimer, Kane, Sullivan and Kurucz

[57] ABSTRACT

A process for annealing steel strip comprising dipping the strip in a molten glass bath maintained 950° C. or higher to anneal it, taking the strip out of the bath to form coagulated glass coatings on the surfaces of the strip and cooling the strip to destroy and peel off the coatings. The bath comprises 38.0 to 62.0% of $B_2O_3$, 18.0 to 32.0% of $SiO_2$, 18.0 to 32.0% of $Na_2O$ partly replaceable with $K_2O$, up to 10.0% of CaO partly replaceable with MgO, BaO, ZnO and/or SrO, up to 6.0% of $Li_2O$, up to 10.0% of $Al_2O_3$ and 0.5 to 4.0% of NaF, and has a viscosity not exceeding 200 poises as measured at 950° C. The strip is preferably not exposed to air while above 400° C.

12 Claims, 4 Drawing Figures

ANNEALING STEEL STRIP USING MOLTEN $B_2O_3$, $SIO_2$ $NA_2O$, NAF GLASS BATH

BACKGROUND OF THE INVENTION

The present invention relates to a process for annealing steel strip. More particularly it relates to a process in which steel strip is annealed by dipping it in a molten glass bath of a low viscosity for a short period of time, advantageously in a continuous manner. Since the process in accordance with the invention makes it possible substantially to prevent the surfaces of the steel strip from being oxidized during annealing, subsequent steps such as pickling and polishing which would otherwise be necessary are not required or at least a burden of such steps may be greatly reduced, and therefore, the process in accordance with the invention is very advantageous from the view point of saving energy and resources.

The objects in annealing steel strip are to remove strains produced by working and to complete recrystallization of steel thereby to obtain a product having desired properties. It is well known in the art that when steel strip is rapidly heated to a temperature required for recrystallization of the grain the desired properties may be achieved.

A continuous process for annealing a steel strip has heretofore been generally practiced using a catenary furnace in which a combustion gas, obtained by burning a fluid fuel such as fuel oils, light oils and propane, is utilized as a heat source. With such a process, however, it is difficult, even in cases where a rapid heating technique is utilized, further to reduce the heating time and thereby increase productivity. This is because, whereas the thermal conductivity of a medium for heating steel strip greatly affects the heating rate of the strip, the combustion gas has a thermal conductivity as low as about $7.6\times10^{-4}$ J/cm.S.K at 1000° C. By setting the temperature in the furnace high, the heating time may be reduced to some extent, but such an approach requires more energy and expensive furnace materials. Moreover, when steel strip is annealed with a combustion gas, oxide scales are formed on the surfaces of the strip, and in consequence, subsequent steps of pickling, shot blast and polishing are required for the removal of the oxide scales. It should be noted that existing installations for treating waste liquors from the pickling step need to be large-sized in order to cope with environmental pollution regulations.

For annealing steel strip without oxidation, various processes have been proposed in which the steel strip is annealed in an inert or reducing gaseous atmosphere. Such processes, however, still attain only limited productivity, because of the limited heating rate attainable. Moreover, they are disadvantageous in that the gaseous atmosphere used is expensive in itself; and equipment for storing the gaseous atmosphere and means for completely sealing the atmosphere in the furnace are required, all leading to an increase of the manufacturing cost of the product.

Japanese Patent Publication No. 55-51496, published on Dec. 24, 1980, proposes an improvement to a known method for enhancing corrosion resistance of an article of austenitic stainless steel in which the article is annealed in an atmosphere of decomposed ammonia gas. The process proposed in this Japanese Patent Publication comprises dipping an austenitic stainless steel article, for example a steel pipe, in a bath of a molten flux maintained at a temperature of from 1050° to 1150° C. to anneal it, the bath comprising in % by weight 48 to 65% of $Na_2B_4O_7$, 35 to 43% of $H_3BO_3$, 3 to 10% of $NaH_2PO_4$ and 3 to 8% of NaF, taking the annealed article out of the bath to form coagulated flux coatings on the surfaces of the article, and quenching the article with warm water to destroy and peel off the coatings from the article. However, the coating of the coagulated flux having the prescribed composition is not very resistant to water and dissolves to some extent in the quenching water and in the washing water. Because of the presence of $NaH_2PO_4$ in the flux and because of a recent severe requirement for control of P in waste water a suitable waste water disposal plant is required. Furthermore, non-oxidation of the steel is not completely ensured. This is partly because the protective property of the coagulated coatings (that is the ability of the coagulated coatings to protect the steel from being oxidized) is insufficient and partly because the article is quenched with water immediately after it has been taken out of the bath and, in consequence, the coagulated coatings are destroyed while the steel article still remains very hot. Accordingly, apart from the fact that the Japanese Patent Publication discloses batchwise annealing of a small article (e.g. a steel pipe of a length of 20 cm), an improvement in the flux composition is desired from the viewpoint of the large scale operation involved in continuous non-oxidative annealing of a continuously running steel strip, recovery and re-use of the used flux in such a large scale operation and treatment of waste water. Also, it is desirable to provide a process for annealing steel strip within a very short period of time. It is especially desirable to provide a continuous process for annealing cold rolled stainless steel strip substantially without forming oxide scales on the surfaces of the strip, particularly in an improved molten glass bath suitable for use in continuous non-oxidative annealing of cold rolled stainless steel strip.

SUMMARY OF THE INVENTION

A process for annealing steel strip in accordance with the invention comprises the steps of dipping steel strip in a molten glass bath maintained at a temperature of at least 950° C. to anneal it, said bath comprising in % by weight 38.0 to 62.0% of $B_2O_3$, 18.0 to 32.0% of $SiO_2$, 8.0 to 32.0% of $Na_2O$, 0 to 20.0% of $K_2O$ with the sum of the $Na_2O$ and $K_2O$ being 8.0 to 32.0%, 0 to 10% of CaO which may be partly replaced with at least one of MgO, BaO, ZnO and SrO, 0 to 6.0% of $Li_2O$, 0 to 10.0% of $Al_2O_3$ and 0.5 to 4.0% of NaF, and having a viscosity not exceeding 200 poises as measured at a temperature of 950° C., taking the annealed strip out of the bath to form coagulated glass coatings on the surfaces of the strip, and cooling the strip to destroy and peel off the coagulated glass coatings from the surfaces of the strip.

Preferably the cooling conditions are controlled so that the surfaces of the strip are not exposed to air when the temperature of the strip is still above 400° C.

DETAILED DESCRIPTION OF THE INVENTION

The following properties are required for the molten glass bath suitable for use in the practice of the invention.

(1) The glass should adhere to the surfaces of the steel strip dipped therein within a short dipping period.

(2) Air should not be entrapped upon dipping the strip in the bath. If air is entrapped those areas of the surfaces of the strip which are in contact with the entrapped air are oxidized.

(3) The pick-up of coagulated glass coatings which are formed on the surfaces of the strip when the strip has been taken out of the bath should be small. It is generally desired that the thickness of the coagulated glass coating is below about 400 microns and the coating pick-up is below about 0.1 g/cm$^2$ per one side. Excessive coating pick-up is disadvantageous because it means the consumption of a lot of heat and a short cycle of building a fresh bath.

(4) The coagulated glass coatings should properly protect the underlying surfaces of the steel strip from being oxidized when the strip is cooled.

(5) While the coagulated glass coatings should not be destroyed when the strip is cooled to a temperature of about 400° C. under suitably selected mild conditions, it should be possible that when the temperature of the strip has reached about 400° C. or below, e.g. about 250° to 400° C., the coatings may readily be destroyed into pieces by forced cooling and substantially completely peeled off from the surfaces of the strip.

(6) When the pieces of the destroyed glass coatings are washed off with water, the glass components should hardly dissolve in the washing water.

(7) Because the bath is maintained at a high temperature, the molten glass in itself should have the property of not being oxidized at high temperatures.

The desired properties of the molten glass bath have now been achieved by suitably balancing the glass composition, in accordance with the invention.

$B_2O_3$ is a network former of the glass. It serves to reduce the melting temperature range and viscosity of the bath, and to enhance the adhesion performance of the glass (prevention of air from being entrapped and lowering of the coating pick-up). At least 38.0% of $B_2O_3$ is required. However, the use of $B_2O_3$ substantially in excess of 62.0% tends not only to reduce the water resistance of the coagulated glass but also unduly to lower the thermal expansion coefficient of the glass. The latter leads to a deterioration of the peeling performance of the coagulated glass coatings.

$SiO_2$ is an essential component to enhance the protective property and water resistance of the coagulated glass coatings, and at least 18.0% is required. However, the use of $SiO_2$ substantially in excess of 32.0% renders the viscosity of the bath unduly high, leading to a deterioration of the adhesion performance of the molten glass (air is entrapped becoming a cause of local oxidation).

$Na_2O$ is a component to modify the melting temperature range of the bath and at least 8.0% is used. However, the addition of $Na_2O$ substantially in excess of 32.0% tends to result in coagulated glass coatings which have a reduced water resistance and which are liable to be destroyed while the strip is still within an oxidation temperature range above 400° C.

A part (up to 20% of the bath) of the $Na_2O$ may be replaced with $K_2O$.

It is preferred to add a small amount of CaO to the bath for the purpose of lowering the thermal expansion coefficient of the coagulated glass coatings. However, the addition of an excessive amount of CaO tends to increase the viscosity of the bath and adversely affect the protective property of the coagulated glass coatings. Moreover, a part of the CaO added does not melt and floats on the bath. For these reasons the addition of CaO substantially in excess of 10.0% should be avoided. A part of the CaO may be replaced with MgO, BaO, ZnO and/or SrO.

Up to 6.0% of $LiO_2$ may be added to the bath for the purpose of lowering the melting temperature range of the bath without substantially affecting the thermal expansion coefficient of the coagulated glass coatings. However, the addition of $Li_2O$ substantially in excess of 6.0% must be avoided, since it tends to result in coagulated glass coatings which are too adherent to be suitably peeled off from the surfaces of the steel strip.

$Al_2O_3$ serves like $SiO_2$ to enhance the water resistance of the coagulated glass coatings, and may be added to the bath in an amount of up to 10.0%. However, the addition of $Al_2O_3$ substantially in excess of 10.0% tends to not only increase the viscosity of the bath but also deteriorate the protective property of the coagulated glass coatings.

NaF is added to the bath in an amount of 0.5 to 4.0% to prevent the bath itself from being oxidized at high working temperatures. Because NaF corrodes the steel strip, the addition of an excessive amount of NaF must be avoided.

For the purposes of the invention, the viscosity of the molten glass bath is critical. The bath should have a viscosity not exceeding 200 poises, preferably not exceeding 100 poises, when measured at a temperature of 950° C. We have found that if this low viscosity requirement is met the desired properties (1), (2) and (3) above are ensured. In other words it has been confirmed that when the annealing process in accordance with the invention is carried using a molten glass bath having the prescribed composition and a viscosity not exceeding 200 poises as measured at a temperature of 950° C., the molten glass may adhere to the surfaces of the steel strip dipped in the bath within a reasonably short period of time without air being entrapped; and upon removal of the steel strip from the bath the pick-up of coagulated glass coatings can be well below 0.1 g/cm$^2$ per one side and the thickness of the coating can be substantially below 400 microns.

Preferably, the molten glass bath comprises in % by weight 40.0 to 60.0% of $B_2O_3$, 20.0 to 30.0% of $SiO_2$, 10.0 to 30.0% of $Na_2O$, 0 to 20.0% of $K_2O$ with the sum of the $Na_2O$ and $K_2O$ being 10.0 to 30.0%, 1.0 to 7.0% of CaO which may be partly replaced with at least one of MgO, BaO, ZnO and SrO, 1.0 to 5.0% of $Li_2O$, 3.0 to 8.0% of $Al_2O_3$ and 1.0 to 3.0% of NaF, and has a viscosity not exceeding 100 poises as measured at a temperature of 950° C.

A process for annealing steel strip according to the invention comprises maintaining a molten glass bath having the prescribed composition and viscosity at a temperature of at least 950° C., usually not higher than 1250° C., dipping steel strip in the bath to anneal it, taking the strip out of the bath to form coagulated glass coatings on the surfaces of the strip, and cooling the strip to destroy and peel off the coagulated glass coatings from the surfaces of the strip. Preferably, the cooling conditions are controlled so that the surfaces of the strip are not exposed to air when the temperature of the strip is still above 400° C.

While the process according to the invention is particularly applicable to continous non-oxidative annealing of cold rolled stainless steel strip, it may also be applied to annealing of cold rolled strip of normal or special steel as well as to annealing of hot rolled steel strip coated with oxide scales. In the latter case, descaling can be effected simultaneously with annealing.

In an advantageous continuous operation, the steel strip is continuously introduced into the bath, caused to travel through the bath at a predetermined line speed and continuously taken out of the bath. Since the molten glass bath used in the process of the invention has a very high thermal conductivity (for example, $0.67\times10^{-2}$ J/cm.S.K at 1000° C.) when compared with that of the heating atmosphere of normal catenary furnaces, the steel strip dipped in the bath can be rapidly heated and annealed. The desired anneal can be accomplished by suitably setting the bath temperature and dipping time (line speed) depending upon the steel species. When compared with a prior art annealing process using a catenary furnace, the process according to the invention is advantageous in that the required heating time to achieve the same level of annealing is very short. We have found that the required heating time can be shortened by the invention by about 70 to 80% or more. The reduction of heating time means the increase in productivity.

After being dipped in the molten glass bath for a predetermined period of time, the steel strip is taken out of the bath whereupon coagulated glass coatings are formed on the surfaces of the strip. On the one hand the coatings should properly protect the underlying steel surfaces from being oxidized, and on the other hand the coating pick-up should not be unduly excessive. It has been found that these requirements are met by the molten glass bath proposed herein.

The steel strip having the coagulated glass coatings is then cooled so that the coatings are destroyed owing to the difference in the thermal expansion coefficient between the steel and glass, and peeled off from the surfaces of the strip. Preferably, the cooling conditions are controlled so that the surfaces of the strip are not exposed to air while the temperature of the strip is still above 400° C., and preferably while the temperature of the strip is still above 300° C. This is because if the surfaces of the strip are exposed to air while the strip is still in an oxidation temperature range, the exposed areas of the strip are oxidized. If the cooling is effected with an inert gas such as argon, there is no need to pay attention to the temperature at which the glass coatings are destroyed. However, when the cooling is effected with air, the steel strip taken out of the bath should be initially gently cooled or allowed to cool at least until the temperature of the strip reaches 400° C., preferably 300° C., and thereafter the destruction and peeling off of the glass coatings may be effected by forced rapid cooling with air or water.

After peeling off of the glass coatings the steel strip may be washed with water and pieces of the glass may be recovered and re-used to build up a fresh bath.

BRIEF EXPLANATION OF THE DRAWINGS

The invention will be further described by the following Examples with reference to the attached drawings, in which.

EXAMPLE 1

Cold rolled strips of SUS 304 and SUS 430 of a thickness of 1.0 mm having chemical compositions indicated in Table 1 were prepared by a conventional process including the steps of continuous strand casting, deflaming, hot rolling pickling and cold rolling. Samples taken from the strips were dipped in a laboratory scale molten glass bath containing in % by weight 45% of $B_2O_3$, 30% of $SiO_2$, 10% of $Na_2O$, 5% of CaO, 5% of $Li_2O$, 4% of $Al_2O_3$ and 1% of NaF, for various periods of time, taken out of the bath and cooled with an argon jet to remove the glass coatings. The temperature of the bath was maintained at 1200° C. for SUS 304 and at 1000° C. for SUS 430 utilizing a rapid heating technique.

TABLE 1

| | C | Si | Mn | P | S | Ni | Cr |
|---|---|---|---|---|---|---|---|
| SUS 304 | 0.06 | 0.25 | 1.50 | 0.026 | 0.006 | 8.03 | 18.21 |
| SUS 430 | 0.07 | 0.27 | 0.31 | 0.021 | 0.007 | 0.12 | 17.85 |

Figure 1:
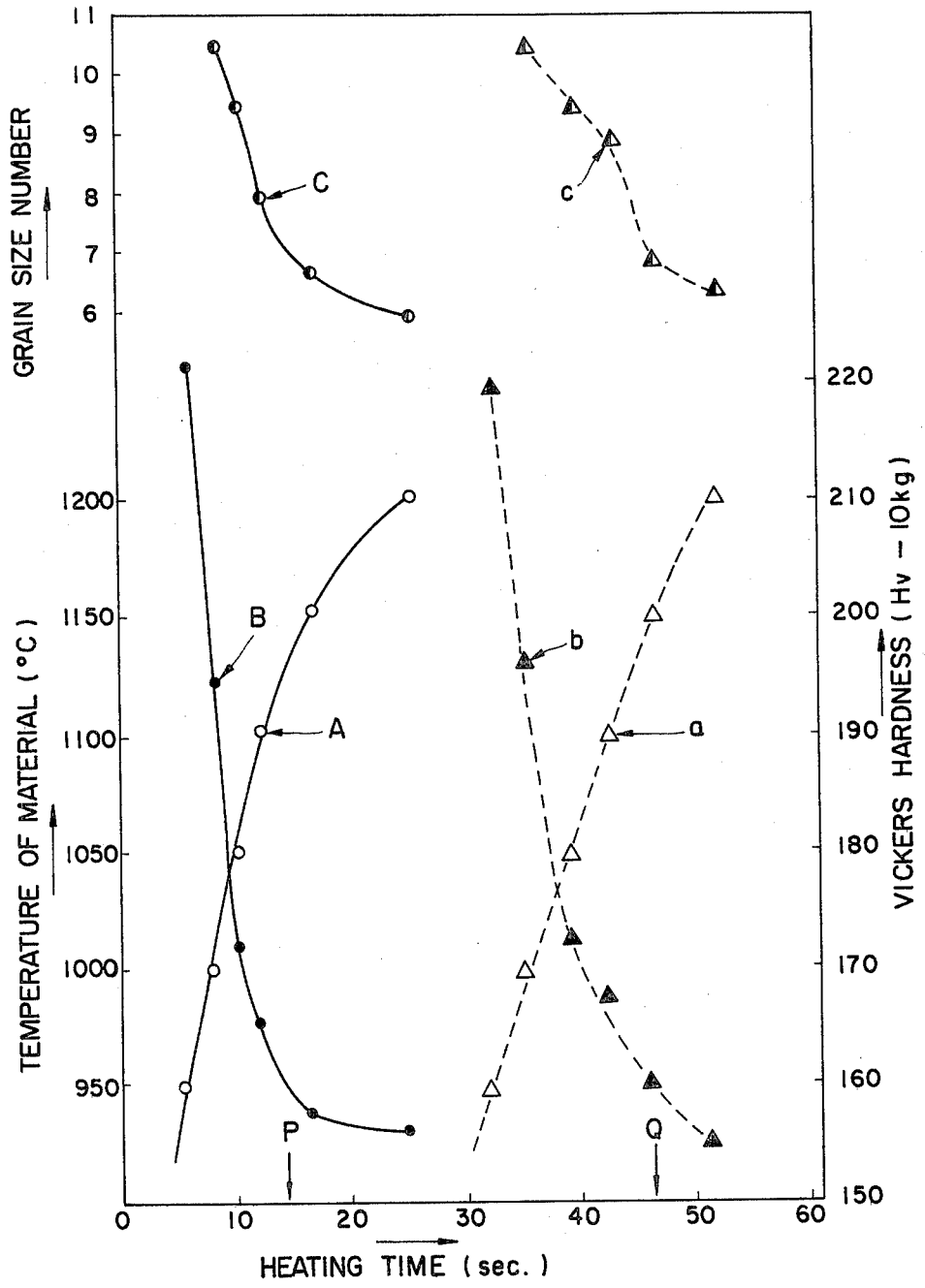
FIG. 1 shows heating curves A and a, softening curves B and b and recrystallization curves C and c, obtained when a cold rolled strip of SUS 304 is annealed by a process according to the invention (A, B and C) and by a prior art process (a, b and c), respectively.

On SUS 304, the change of temperature of the material with time, the change of hardness with time and the change of grain size number with time were determined, and the results are shown in FIG. 1 by curves A (heating curve), B (softening curve) and C (recrystallization curve), respectively. For comparison purposes, samples of the same material were annealed according to a prior art process in a catenary furnace maintained at 1200° C. using light oil as a fuel, and likewise heating, softening and recrystallization curves, which are shown in FIG. 1 with designations a, b and c, respectively, were determined.

Figure 2:
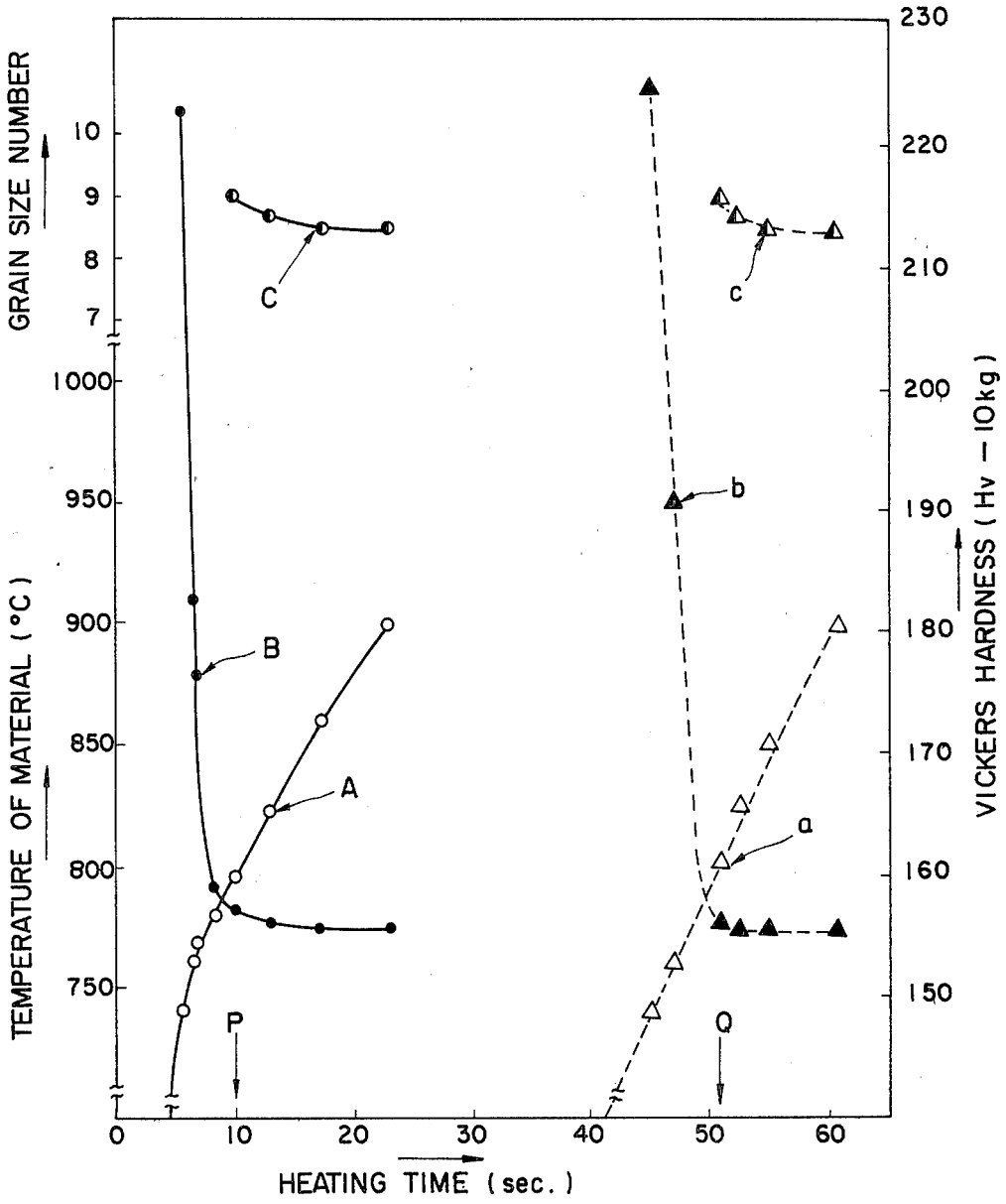
FIG. 2 shows heating curves A and a, softening curves B and b and recrystallization curves C and c, obtained when a cold rolled strip of SUS 430 is annealed by a process according to the invention (A, B and C) and by a prior art process (a, b and c), respectively.

The results obtained on SUS 430 are shown in FIG. 2.

As seen from FIGS. 1 and 2, the process according to the invention can afford a very fast heating rate, when compared with the prior art process. In the case of SUS 304, the time required to heat the material from ambient temperature to 1150° C. was 46 seconds in the prior art and 16.5 seconds in the process according to the invention (see curves a and A in FIG. 1), while in the case of SUS 430, the time required to heat the material from ambient temperature to 800° C. was 50.5 seconds in the prior art process and 10.5 seconds in the process according to the invention (see curves a and A in FIG. 2). Thus, the heating rate attainable by the process according to the invention is about three to five times that attainable by the prior art process. This means that the invention has made it possible to shorten the annealing time required to achieve desired properties of the material. P and Q in FIGS. 1 and 2 indicate the heating time at which the material has recrystallized and sufficiently softened in the process according to the invention and in the prior art process, respectively. Table 2 reveals that the annealing time required to achieve desired properties can be shortened by the invention by about 70 to 80% or more.

TABLE 2

| FIG. | Steel | P | Q | Q-P/Q × 100 |
|---|---|---|---|---|
| FIG. 1 | SUS 304 | 14.5 sec. | 46.5 sec. | 68.8% sec. |
| FIG. 2 | SUS 430 | 10.0 sec. | 51.0 sec. | 80.4% sec. |

The properties of the annealed samples which have been annealed in the bath for the time indicated in Table 2 are shown in Table 3. It is revealed from Table 3 that the qualities of the products annealed in accordance with the invention are quite normal.

TABLE 3

| | Steel | 0.2% Proof ($kg/mm^2$) | Tensile strength ($kg/mm^2$) | Elongation (%) | Bend property | Hardness (Hv) | Grain Size number |
|---|---|---|---|---|---|---|---|
| According to invention | SUS 304 | 28.0 | 67.3 | 61.0 | close bend possible | 160 | 7.0 |
| | SUS 430 | 32.7 | 47.0 | 33.0 | close bend possible | 156 | 9.5 |
| Prior art | SUS 304 | 28.2 | 67.0 | 62.0 | close bend possible | 161 | 7.0 |
| | SUS 430 | 32.0 | 47.1 | 33.0 | close bend possible | 155 | 9.5 |

Figure 3:
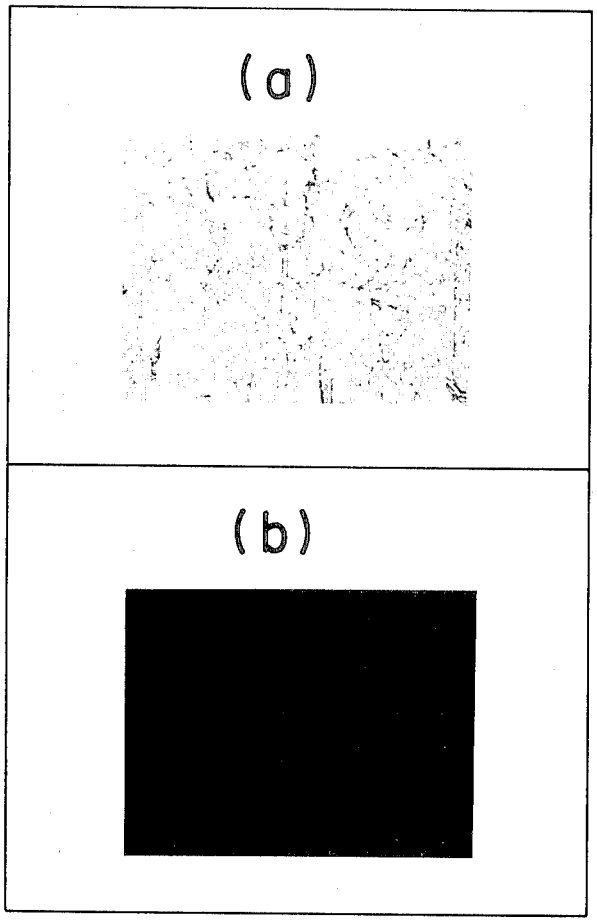
FIGS. 3(*a*) and (*b*) are optical microscopic photographs showing the appearance of cold rolled strips of SUS 304 which have been annealdd by a process according to the invention and by a prior art process, respectively.

The appearance of SUS 304 which has been annealed by the process according to the invention and that of the same material which has been annealed by the prior art process are shown in FIGS. 3(*a*) and (*b*), respectively, at magnification of 200. It can be seen that the product annealed by the process according to the invention has an attractive appearance, when compared with that of the product which has been annealed by the prior art process and is covered by oxide scales.

EXAMPLE 2

Figure 4:
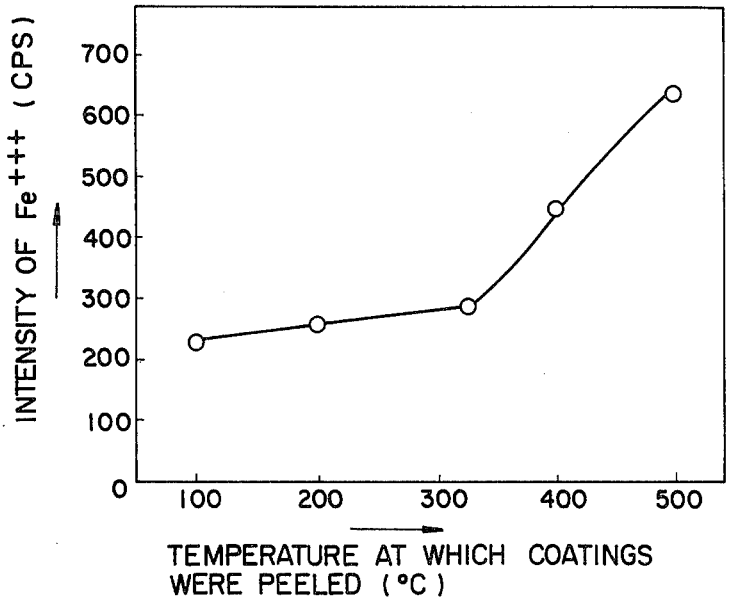
FIG. 4 is a graphical showing of the dependency of the extent of oxidation of a steel surface plotted against the temperature at which the surface is exposed to air by destruction of coating glass during the course of cooling.

Samples taken from the cold rolled strip of SUS 430 having a chemical composition indicated in Table 1 were dipped in the molten glass bath described in Example 1 and maintained at 1000° C. for 23 seconds, taken out of the bath, allowed to cool in air to various temperatures and then cooled with water to destroy and peel off the coagulated glass coatings. The surfaces of the samples were tested for the extent of oxidation by measuring the intensity of $Fe^{3+}$ by means of an X-ray photoelectric spectrometer. The results are shown in FIG. 4. It is revealed from FIG. 4 that if surfaces of the material are exposed to air while the temperature is still above 400° C., they are substantially oxidized. Accordingly, it is important not to expose surfaces of the material to air while the temperature of the material is still above 400° C. In order to carry out substantially non-oxidative annealing it is preferred not to expose surfaces of the material to air until the material is cooled to a temperature of about 300° C. or below.

EXAMPLE 3

Molten glass baths Nos. 1 to 10 having compositions indicated in Table 4 were tested. Samples taken from the cold rolled strip of SUS 304 having a composition indicated in Table 1 were used.

The results are shown in Table 5.

TABLE 4

| No. | $B_2O_3$ | $SiO_2$ | $Na_2O$ | $K_2O$ | CaO | $Li_2O_3$ | $Al_2O_3$ | NaF | Temp. of 100 poises* (°C.) |
|---|---|---|---|---|---|---|---|---|---|
| 1 | 70 | 15 | 20 | — | — | 1 | 3 | 1 | 850 |
| 2 | 65 | 20 | 5 | — | 3 | 1 | 2 | 1 | 900 |
| 3 | 60 | 20 | 10 | 4 | 1 | 1 | 3 | 1 | 895 |
| 4 | 55 | 20 | 14 | — | 1 | 1 | 8 | 1 | 930 |
| 5 | 50 | 20 | 10 | — | 10 | 5 | 4 | 1 | 900 |
| 6 | 40 | 20 | 10 | 12 | 7 | 5 | 3 | 3 | 880 |
| 7 | 40 | 25 | 33 | — | 15 | 7 | 12 | 1 | 1030 |
| 8 | 40 | 30 | 24 | — | 1 | 1 | 3 | 1 | 910 |
| 9 | 35 | 35 | 20 | — | 3 | 1 | 5 | 1 | 1100 |
| 10 | 25 | 40 | 20 | 4 | 1 | 5 | — | 5 | 1130 |

*Temperature in °C. of the bath has a viscosity of poises.

TABLE 5

| No. | Adhesion performance | Coating pick-up per one side ($g/cm^2$) | Protective property | Water resistance | Peeling performance | Thickness of coating (u) | All-out rating |
|---|---|---|---|---|---|---|---|
| 1 | G | 0.062 | G | U | U | 254 | U |
| 2 | G | 0.067 | U | U | U | 318 | U |
| 3 | G | 0.052 | G | G | G | 230 | G |
| 4 | G | 0.081 | G | G | G | 351 | G |
| 5 | G | 0.067 | G | G | G | 290 | G |

TABLE 5-continued

| No. | Adhesion performance | Coating pick-up per one side (g/cm$^2$) | Protective property | Water resistance | Peeling performance | Thickness of coating (u) | All-out rating |
|---|---|---|---|---|---|---|---|
| 6 | G | 0.066 | G | G | G | 370 | G |
| 7 | U | 0.195 | U | U | U | 580 | U |
| 8 | G | 0.085 | G | G | G | 276 | G |
| 9 | U | 0.109 | G | G | U | 414 | U |
| 10 | U | 0.121 | G | G | U | 427 | U |

G: good
U: unsatisfactory

Adhesion performance

A sample of the cold rolled strip of SUS 304 was dipped in the bath to be tested maintained at a temperature of 950° C. for 60 seconds. At the end of the period the sample was taken out of the bath and allowed to cool. The sample was examined for the presence of any voids in its coagulated glass coatings. Another sample was dipped in the bath at 950° C. for 60 seconds, taken out of the bath, allowed to cool to a temperature of about 300° C. and then cooled with water to destroy and peel off the coatings. The sample was examined for the presence of any oxidized spots on its surfaces caused by entrapped air. Oxidation by entrapped air can readily be distinguished from that which has occurred in the cooling step owing to poor protection of the coagulated glass coatings, since the latter appears as a tortoiseshell pattern and results in a thin film of oxide. In the case wherein neither voids in the coagulated glass coatings nor oxidized spots on the surfaces of the steel were observed, the bath was rated as having a good adhesion performance.

Coating pick-up

The coating pick-up was determined on the sample which was used in the first test for checking the adhesion performance. The coating pick-up should preferably be not in excess of 0.1 g/cm$^2$ per one side.

Protective property

A sample of the cold rolled strip of SUS 304 was dipped in the bath to be tested maintained at a temperature of 950° C. for 60 seconds, taken out of the bath and immediately placed in an open "Elema" electric furnace maintained at a temperature of 600° C. for a period of 10 minutes. At the end of the period, the sample was taken out of the furnace, allowed to cool in air to a temperature of about 200° C. and then rapidly cooled with water to destroy and peel off coagulated glass coatings. The oxide intensity on the surface of the sample was measured before and after the annealing procedure using an X-ray photoelectric spectrometer. In the case where no increase in the oxide intensity was observed, the glass was rated as having a good protective property.

Peeling performance of coagulated glass

In the second test for checking the adhesion performance, observation was made as to whether or not the coatings had peeled off completely. In the case where the coagulated glass coatings had substantially completely peeled off, the peeling performance was rated as good.

Water resistance

A coagulated glass sample was leached in boiling water for 30 minutes. In the case where the weight loss of the sample by this leaching was less than 0.5%, the glass was rated as having a good water resistance.

Thickness of glass coating

Each indicated value is an average of 5 measurements made by means of a micrometer.

EXAMPLE 4

Using a continuous non-oxidative annealing installation comprising a vessel having a length of 1 m, a width of 1.5 m and a depth of 2 m and designed so that a continuous strip of steel to be annealed could be introduced obliquely and then caused to pass vertically through the vessel, a cold rolled strip of SUS 304 of the composition shown in Table 1 having a thickness of 1.0 mm and a width of 300 mm was continuously annealed. A molten glass bath having the same composition as the bath No. 4 shown in Table 4 was held in the vessel and maintained at a temperature of 1200° C. The strip was continuously introduced and caused to pass through the bath in 15 seconds. This means that the line speed was 8 m/min. The strip which had left the bath was cooled with argon to destroy and peel off coagulated glass coatings.

Optical microscope observation showed that the surfaces of the annealed product were very attractive with no alien substance. The product had a 0.2% proof of 27.9 kg/mm$^2$, a tensile strength of 67.7 kg/mm$^2$, an elongation of 61.2%, a Vickers hardness (Hv) of 160 and a grain size number of 7.0.

EXAMPLE 5

Using the continuous non-oxidative annealing installation described in Example 4, a cold rolled strip of SUS 430 of the composition shown in Table 1 having a thickness of 1.0 mm and a width of 300 mm was continuously annealed. The molten glass bath used had the same composition as the bath No. 6 shown in Table 4, and was maintained at a temperature of 1000° C. The line speed was set at 12 m/sec. The strip which left the bath was allowed to cool in air until the temperature of the strip reached 300° C. and then the coagulated glass coatings were destroyed and peeled off by blowing with cold air.

The surfaces of the annealed product were very attractive and free from oxide scale and pieces of destroyed glass coating. The product had a 0.2% proof of 31.0 kg/mm$^2$, a tensile strength of 48.2 kg/mm$^2$, an elongation of 32.5%, a Vickers hardness (Hv) of 157 and a grain size number of 9.5.

What is claimed is:

1. A process for annealing steel strip comprising the steps of dipping the steel strip in a molten glass bath maintained at a temperature of at least 950° C. to anneal it, said bath consisting essentially in % by weight 38.0 to 62.0% of $B_2O_3$, 18.0 to 32.0% of $SiO_2$, 8.0 to 32.0% of $Na_2O$, 0 to 20.0% of $K_2O$ with the sum of the $Na_2O$ and $K_2O$ being 8.0 to 32.0%, 0 to 10.0% of CaO which may be partly replaced with at least one of MgO, BaO, ZnO and SrO, 0 to 6.0% of $Li_2O$, 0 to 10.0% of $Al_2O_3$ and 0.5 to 4.0% of NaF, and having a viscosity not exceeding 200 poises as measured at a temperature of 950° C., taking the strip out of the bath to form coagulated glass coatings on the surfaces of the strip, and cooling the strip to destroy and peel off the coagulated glass coatings from the surfaces of the strip.

2. A process in accordance with claim 1 wherein said molten glass bath consisting essentially in % by weight 40.0 to 60.0% of $B_2O_3$, 20.0 to 30.0% of $SiO_2$, 10.0 to 30.0% of $Na_2O$, 0 to 20.0% of $K_2O$ with the sum of the $Na_2O$ and $K_2O$ being 10.0 to 30.0%, 1.0 to 7.0% of CaO which may be partly replaced with at least one of MgO, BaO, ZnO and SrO, 1.0 to 5.0% of $Li_2O$, 3.0 to 8.0% of $Al_2O_3$ and 1.0 to 3.0% of NaF, and has a viscosity not exceeding 100 poises as measured at a temperature of 950° C.

3. A process in accordance with claim 1 or claim 2 wherein the process is carried out continuously.

4. A process in accordance with any one of the preceding claims wherein the steel strip is a cold rolled strip of stainless steel.

5. A process for annealing steel strip, comprising the step of dipping the steel strip in a molten glass bath maintained at a temperature of at least 950° C. to anneal it, said bath consisting essentially in % by weight 38.0 to 62.0% of $B_2O_3$, 18.0 to 32.0% of $SiO_2$, 8.0 to 32.0% of $Na_2O$, 0 to 20.0% of $K_2O$ with the sum of the $Na_2O$ and $K_2O$ being 8.0 to 32.0%, 0 to 10.0% of CaO which may be partly replaced with at least one of MgO, BaO, ZnO and SrO, 0 to 6.0% of $Li_2O$, 0 to 10.0% of $Al_2O_3$ and 0.5 to 4.0% of NaF, and having a viscosity not exceeding 200 poises as measured at a temperature of 950° C., taking the strip out of the bath to form coagulated glass coatings on the surfaces of the strip, and cooling the strip to destroy and peel off the coagulated glass coatings from the surfaces of the strip, the cooling conditions being controlled so that the surfaces of the strip are not exposed to air when the temperature of the strip is still above 400° C.

6. A process in accordance with claim 1 wherein said molten glass bath consisting essentially in % by weight 40.0% to 60.0% of $B_2O_3$, 20.0 to 30.0% of $SiO_2$, 10.0 to 30.0% of $Na_2O$, 0 to 20.0% of $K_2O$ with the sum of the $Na_2O$ and $K_2O$ being 10.0 to 30.0% 1.0 to 7.0% of CaO which may be partly replaced with at least one of MgO, BaO, ZnO and SrO, 1.0 to 5.0% of $Li_2O$, 3.0 to 8.0% of $Al_2O_3$ and 1.0 to 3.0% of Naf, and has a viscosity not exceeding 100 poises as measured at a temperature of 950° C.

7. A process in accordance with claim 5 or claim 6 wherein the strip taken out of the bath is cooled with an inert gas to destroy and peel off the coagulated glass coatings are from the surfaces of the strip.

8. A process in accordance with claim 7 wherein said inert gas is argon.

9. A process in accordance with claim 5 or claim 6 wherein the strip taken out of the bath is initially allowed to cool without the destruction of the coagulated glass coatings, and after the temperature of the strip has fallen to 400° C. a temperature not higher than the strip is forcibly cooled to destroy and peel off the coagulated glass coatings from the surfaces of the strip.

10. A process in accordance with claim 9 wherein after the temperature of the strip has fallen to a temperature not more than 300° C. the strip is forcibly cooled.

11. A process in accordance with any one of claims 5 through 10 wherein the process is continuously carried out.

12. A process in accordance with any one of claims 5 through 11 wherein the steel strip is a cold rolled strip of stainless steel.

* * * * *

UNITED STATES PATENT AND TRADEMARK OFFICE

CERTIFICATE OF CORRECTION

PATENT NO. : 4,473,412

DATED : September 25, 1984

INVENTOR(S) : Shigeaki Maruhashi et al

It is certified that error appears in the above-identified patent and that said Letters Patent is hereby corrected as shown below:

Column 7, lines 7 and 9, in Table 2, last column (Q-P/Q X 100) delete "sec."

Column 8, at the end of Table 4, " *Temperature in °C. of the bath has a viscoity of poises" should be -- *Temperature in °C of the bath at which the bath has a viscosity of 100 poises.--.

Column 12, line 28, in claim 9, after "fallen to" insert --a temperature not higher than-- and delete "a temperature not higher than" after "400° C.".

Signed and Sealed this

Sixteenth Day of April 1985

[SEAL]

*Attest:*

DONALD J. QUIGG

*Attesting Officer* *Acting Commissioner of Patents and Trademarks*